US010729246B2

(12) United States Patent
Sweeney

(10) Patent No.: US 10,729,246 B2
(45) Date of Patent: Aug. 4, 2020

(54) PERSON SUPPORT APPARATUS WITH SHEAR-REDUCING PIVOT ASSEMBLY

(71) Applicant: Stryker Corporation, Kalamazoo, MI (US)

(72) Inventor: Christopher Ryan Sweeney, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 44 days.

(21) Appl. No.: 16/217,373

(22) Filed: Dec. 12, 2018

(65) Prior Publication Data

US 2019/0191880 A1 Jun. 27, 2019

Related U.S. Application Data

(60) Provisional application No. 62/609,039, filed on Dec. 21, 2017.

(51) Int. Cl.

| | |
|---|---|
| ***A61G 5/10*** | (2006.01) |
| ***A61G 5/12*** | (2006.01) |
| ***A47C 1/024*** | (2006.01) |
| ***A61G 7/015*** | (2006.01) |
| ***A47C 17/16*** | (2006.01) |
| ***A61G 1/017*** | (2006.01) |
| ***A61G 7/16*** | (2006.01) |
| *A61G 5/00* | (2006.01) |

(52) U.S. Cl.

CPC ..... *A47C 1/024* (2013.01); *A47C 17/16* (2013.01); *A61G 1/017* (2013.01); *A61G 5/1067* (2013.01); *A61G 7/015* (2013.01); *A61G 7/16* (2013.01); *A61G 5/006* (2013.01); *A61G 2203/74* (2013.01)

(58) Field of Classification Search

CPC ..... A61G 7/015; A61G 7/018; A61G 7/00; A61G 7/0507; A61G 7/0509

See application file for complete search history.

(56) References Cited

U.S. PATENT DOCUMENTS

| | | | |
|---|---|---|---|
| 2,863,495 | A | 12/1958 | Knabusch et al. |
| 3,394,965 | A | 7/1968 | Fletcher |
| 3,869,172 | A | 3/1975 | James et al. |
| 4,077,663 | A | 3/1978 | Cycowicz et al. |

(Continued)

OTHER PUBLICATIONS

Hill-Rom Centrella Smart Bed Manual, Sep. 28, 2017.

*Primary Examiner* — Shin H Kim

(74) *Attorney, Agent, or Firm* — Warner Norcross + Judd LLP

(57) ABSTRACT

A person support apparatus includes a support surface for supporting a person thereon. The support surface includes at least a seat and a backrest coupled together by a pivot assembly. In some embodiments, the pivot assembly includes a backrest slide bar mounted to the backrest and a seat slide bar mounted to the seat. The backrest and seat slide along their respective slide bars when the backrest pivots. A seat link is coupled to the seat and backrest slide bar, and a backrest link is coupled to the backrest and seat slide bar. The slide bars are coupled at their ends to each other. The pivot assembly creates a virtual pivot axis that, as the backrest pivots from an upright position to a reclined position, moves backward and upwardly. Elongate openings may be defined in the slide bars to support the slide bars on the seat and backrest, respectively.

20 Claims, 8 Drawing Sheets

(56) References Cited

U.S. PATENT DOCUMENTS

| | | | |
|---|---|---|---|
| 4,127,906 | A | 12/1978 | Zur |
| 4,376,316 | A | 3/1983 | Mercier et al. |
| 4,805,961 | A | 2/1989 | Garrod |
| 5,131,717 | A | 7/1992 | Kaminiski et al. |
| 5,150,948 | A | 9/1992 | Volkle |
| 5,329,657 | A | 7/1994 | Bartley et al. |
| 5,404,604 | A | 4/1995 | Has et al. |
| 5,444,880 | A | 8/1995 | Weismiller et al. |
| 5,537,701 | A | 7/1996 | Elliott |
| 5,577,280 | A | 11/1996 | Elliott |
| 5,682,631 | A | 11/1997 | Weismiller et al. |
| 5,823,621 | A | 10/1998 | Broadhead |
| 5,870,784 | A | 2/1999 | Elliott |
| 5,890,765 | A | 4/1999 | LePointe et al. |
| 5,906,017 | A | 5/1999 | Ferrand et al. |
| 5,996,151 | A | 12/1999 | Bartow et al. |
| 6,154,899 | A | 12/2000 | Brooke et al. |
| 6,212,713 | B1 | 4/2001 | Kuck et al. |
| 6,276,011 | B1 | 8/2001 | Antinori |
| 6,336,235 | B1 | 1/2002 | Ruehl |
| 6,393,641 | B1 | 5/2002 | Hensley |
| 6,516,480 | B2 | 2/2003 | Elliott |
| 6,694,549 | B2 | 2/2004 | Perez et al. |
| 6,718,580 | B2 | 4/2004 | Heimbrock et al. |
| 6,789,280 | B1 | 9/2004 | Paul |
| 6,826,793 | B2 | 12/2004 | Tekulve |
| 6,839,926 | B2 | 1/2005 | Heimbrock et al. |
| 6,902,233 | B2 | 6/2005 | Tseng |
| 6,907,631 | B2 | 6/2005 | Heaton |
| 6,929,320 | B2 | 8/2005 | Laurent |
| 6,945,605 | B2 | 9/2005 | Kinoshita et al. |
| 7,000,272 | B2 | 2/2006 | Allen et al. |
| 7,021,711 | B1 | 4/2006 | Hoffman et al. |
| 7,036,166 | B2 | 5/2006 | Kramer et al. |
| 7,114,770 | B2 | 10/2006 | Murphy |
| 7,137,160 | B2 | 11/2006 | Hand et al. |
| 7,165,227 | B2 | 1/2007 | Taguchi et al. |
| 7,165,277 | B2 | 1/2007 | Taguchi et al. |
| 7,195,583 | B2 | 3/2007 | Leib |
| 7,201,425 | B2 | 4/2007 | Tsujibayashi et al. |
| 7,427,105 | B2 | 9/2008 | Knoblock et al. |
| 7,523,515 | B2 | 4/2009 | Allen et al. |
| 7,543,885 | B2 | 6/2009 | Pollard et al. |
| 7,568,765 | B2 | 8/2009 | Brauning |
| 7,610,638 | B2 | 11/2009 | Kramer et al. |
| 7,614,697 | B1 | 11/2009 | Lai |
| 7,762,625 | B2 | 7/2010 | Hoffman et al. |
| 7,878,593 | B2 | 2/2011 | Nae |
| 7,913,336 | B2 | 3/2011 | Morin et al. |
| 7,926,131 | B2 | 4/2011 | Menkedick et al. |
| 7,997,644 | B2 | 8/2011 | Hoffman et al. |
| 8,016,348 | B2 | 9/2011 | Hoffman et al. |
| 8,029,061 | B2 | 11/2011 | Fukai |
| 8,068,924 | B2 | 11/2011 | Nagaoka et al. |
| 8,096,615 | B2 | 1/2012 | Parker et al. |
| 8,113,574 | B2 | 2/2012 | Hoffman et al. |
| 8,123,288 | B2 | 2/2012 | Murphy et al. |
| 8,272,694 | B2 | 9/2012 | Hawkins et al. |
| 8,297,693 | B2 | 10/2012 | Hoffman et al. |
| 8,360,516 | B2 | 1/2013 | Dowty et al. |
| 8,403,409 | B2 | 3/2013 | Pollard et al. |
| 8,403,415 | B2 | 3/2013 | Lawson |
| 8,403,418 | B2 | 3/2013 | Lindell |
| 8,414,074 | B2 | 4/2013 | Kramer et al. |
| 8,419,133 | B2 | 4/2013 | Holt et al. |
| 8,444,223 | B2 | 5/2013 | Moegling et al. |
| 8,449,027 | B2 | 5/2013 | Wiecek |
| 8,459,733 | B2 | 6/2013 | Hoffman et al. |
| 8,500,203 | B2 | 8/2013 | Erb et al. |
| 8,806,682 | B2 | 8/2014 | Hornbach et al. |
| 8,882,190 | B2 * | 11/2014 | Garland ..... A47C 7/506 297/85 L |
| 9,668,928 | B2 | 6/2017 | Paul et al. |
| 2004/0103476 | A1 | 6/2004 | Barcesat |
| 2005/0172405 | A1 * | 8/2005 | Menkedick ..... A61B 5/1115 5/618 |
| 2006/0143829 | A1 | 6/2006 | Kramer et al. |
| 2008/0012414 | A1 | 1/2008 | Dewert |
| 2012/0112519 | A1 | 5/2012 | Murphy et al. |
| 2012/0153704 | A1 | 6/2012 | Hoffman et al. |
| 2012/0286557 | A1 | 11/2012 | Hoffman et al. |
| 2013/0020774 | A1 | 1/2013 | Brittingham et al. |
| 2013/0099546 | A1 | 4/2013 | Kramer et al. |
| 2013/0134758 | A1 | 5/2013 | Kladde |
| 2013/0175841 | A1 | 7/2013 | Finck |
| 2013/0200658 | A1 | 8/2013 | Hoffman et al. |
| 2013/0200659 | A1 | 8/2013 | Hoffman et al. |
| 2016/0227929 | A1 | 8/2016 | Paul et al. |

* cited by examiner 42
76
80
102
D1
78
82
44
42
80
76
D3
D2
102
78
82
44

PERSON SUPPORT APPARATUS WITH SHEAR-REDUCING PIVOT ASSEMBLY

CROSS-REFERENCE TO RELATED APPLICATIONS

This application claims priority to U.S. provisional patent application Ser. No. 62/609,039 filed Dec. 21, 2017, by inventor Christopher Ryan Sweeney and entitled PERSON SUPPORT APPARATUS WITH SHEAR-REDUCING PIVOT ASSEMBLY, the complete disclosure of which is incorporated herein by reference.

BACKGROUND

The present disclosure relates to a person support apparatus, and more particularly to a person support apparatus having a backrest that is pivotal with respect to a seat section.

Person support apparatuses, such as beds, stretchers, cots, recliners, and the like, often include a support surface having a plurality of sections, such as a seat section, a backrest section, and, in some cases, a thigh section and/or a leg rest section. The backrest section is often pivotal with respect to the seat section so that the patient may sit up and, when desired, lean back to a reclined position or a flat position. When pivoting the backrest section, prior art person support apparatuses often introduce a shear force against the patient's back because the backrest and seat do not pivot with respect to each other in a manner that matches the pivoting of the patient's back with respect to his or her hips. As a result, the patient experiences a shear force on his or her back that bunches or stretches his or her shirt, and/or that causes other discomfort as the backrest pivots.

SUMMARY

The present disclosure is directed to a person support apparatus having a pivot assembly that helps reduce shear forces experienced by a patient supported thereon as the backrest pivots with respect to the seat section. In addition to reducing shear forces, in some embodiments, the pivot assembly occupies a relatively small amount of space, uses less material, and overall imposes fewer less space constraints on the other components of the person support apparatus. The pivot assembly, in some embodiments, creates a virtual pivot axis that shifts the backrest backwards and upwards as the backrest pivots upwardly from a first position to a more upright position.

According to one embodiment, a person support apparatus is provided that includes a frame, a seat, a backrest, a seat slide bar, a backrest slide bar, a seat link, and a backrest link. The seat defines a seat plane and the seat is supported on the frame. The backrest defines a backrest plane and the backrest is pivotally coupled to the seat such that the backrest is able to pivot with respect to the seat. The backrest slide bar is mounted to the backrest and adapted to slide along the backrest parallel to the backrest plane. The seat slide bar is mounted to the seat and adapted to slide along the seat parallel to the seat plane. The backrest link is pivotally coupled to the backrest and the seat slide bar, and the seat link is pivotally coupled to the seat and the backrest slide bar.

According to other aspects of the present disclosure, the person support apparatus further comprises an elongate opening defined in the backrest slide bar and first and second supports fixedly coupled to the backrest. The first and second supports are positioned in the elongate opening and adapted to support the backrest slide bar as the backrest slide bar slides along the backrest.

The person support apparatus may further include an elongate opening defined in the seat slide bar and third and fourth supports fixedly coupled to the seat. In such embodiments, the third and fourth supports are positioned in the elongate opening of the seat slide bar and are adapted to support the seat slide bar as the seat slide bar slides along the seat.

In some embodiments, a pivot joint couples the first end of the backrest slide bar to a second end of the seat slide bar. The pivot joint enables the backrest slide bar to pivot with respect to the seat slide bar.

The backrest may be adapted to pivot with respect to the seat about a virtual pivot axis that moves as the backrest pivots with respect to the seat. In some embodiments, the virtual pivot axis moves toward a foot end of the person support apparatus as the backrest pivots toward an upright position, and moves toward a head end of the person support apparatus as the backrest pivots toward a downward position.

In at least one embodiment, the person support apparatus further comprises a second backrest slide bar, a second seat slide bar, a second backrest link, and a second seat link. The second backrest slide bar is mounted to the backrest and adapted to slide along the backrest parallel to the backrest plane. The second seat slide bar is mounted to the seat and adapted to slide along the seat parallel to the seat plane. The second backrest link is pivotally coupled to the backrest and the second seat slide bar, and the second seat link is pivotally coupled to the seat and the second backrest slide bar.

In some embodiments, the person support apparatus further comprises a cross-bar coupled between the first and second backrest slide bars, and/or between the first and second seat slide bars. An electric actuator may be included having a first end coupled to the cross-bar and a second end coupled to either the seat or the backrest.

In some embodiments, the elongate openings in the backrest slide bar and the seat slide bar are both straight.

According to another embodiment of the present disclosure, a person support apparatus is provided that includes a frame, a seat, a backrest, first and second backrest slide bars, first and second seat slide bars, first and second pivot joints, and an actuator. The seat is supported on the frame and the backrest is pivotally coupled to the seat such that the backrest is able to pivot with respect to the seat. The first backrest slide bar is mounted to a first side of the backrest and slides along the backrest, and the second backrest slide bar is mounted to a second side of the backrest and slides along the backrest. The first seat slide bar is mounted to a first side of the seat and slides along the seat, and the second seat slide bar is mounted to a second side of the seat and slides along the seat. The first pivot joint couples the first backrest slide bar to the first seat slide bar, and the second pivot joint couples the second backrest slide bar to the second seat slide bar. The actuator exerts a force against the first and second pivot joints such that the backrest pivots with respect to the seat.

According to other aspects of the present disclosure, the person support apparatus further comprises first and second backrest links and first and second seat links. The first backrest link is pivotally coupled to the backrest and the first seat slide bar, and the second backrest link is pivotally coupled to the backrest and the second seat slide bar. The first seat link is pivotally coupled to the seat and the first backrest slide bar, and the second seat link is pivotally coupled to the seat and the second backrest slide bar.

In some embodiments, the person support apparatus further comprises first, second, third, and fourth supports, as well as a first second elongate opening in the first backrest slide bar and a second elongate opening in the second backrest slide bar. The first and second supports are fixedly coupled to the first side of the backrest, and the third and fourth supports are fixedly coupled to the second side of the backrest. The first and second supports are positioned in the first elongate opening and support the first backrest slide bar as the first backrest slide bar slides along the backrest. The third and fourth supports are positioned in the second elongate opening and support the second backrest slide bar as the second backrest slide bar slides along the backrest.

In some embodiments, the person support apparatus further comprises fifth, sixth, seventh, and eighth supports, as well as a third elongate opening in the first seat slide bar and a fourth elongate opening in the second seat slide bar. The fifth and sixth supports are fixedly coupled to the first side of the seat, and the seventh and eighth supports are fixedly coupled to the second side of the seat. The fifth and sixth supports are positioned in the third elongate opening of the first seat slide bar and support the first seat slide bar as the first seat slide bar slides along the seat. The seventh and eighth supports are positioned in the fourth elongate opening of the second seat slide bar and support the second seat slide bar as the second seat slide bar slides along the seat.

The backrest, in some embodiments, is adapted to pivot with respect to the seat about a virtual pivot axis that moves as the backrest pivots with respect to the seat. The pivot axis moves toward a foot end of the person support apparatus as the backrest pivots toward an upright position, and moves toward a head end of the person support apparatus as the backrest pivots toward a downward position.

The person support apparatus may further comprise a cross-bar extending between the first and second pivot joints. The actuator includes a first end coupled to the cross-bar and a second end coupled to the seat or the backrest.

In some embodiments, the person support apparatus is a bed, and the bed may include a base and a lifting mechanism. The lifting mechanism changes a height of the frame with respect to the base, and the seat and backrest are part of a support deck adapted to support a person positioned on the person support apparatus.

In other embodiments, the person support apparatus is a recliner, and the recliner may include a base, a leg rest, and a set of armrests. The leg rest is movable between an extended and a retracted position. In still other embodiments, the person support apparatus is a cot, a stretcher, an operating table, a dental chair, or another support apparatus having a pivotal backrest adapted to support a person thereon in a plurality of angular orientations.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
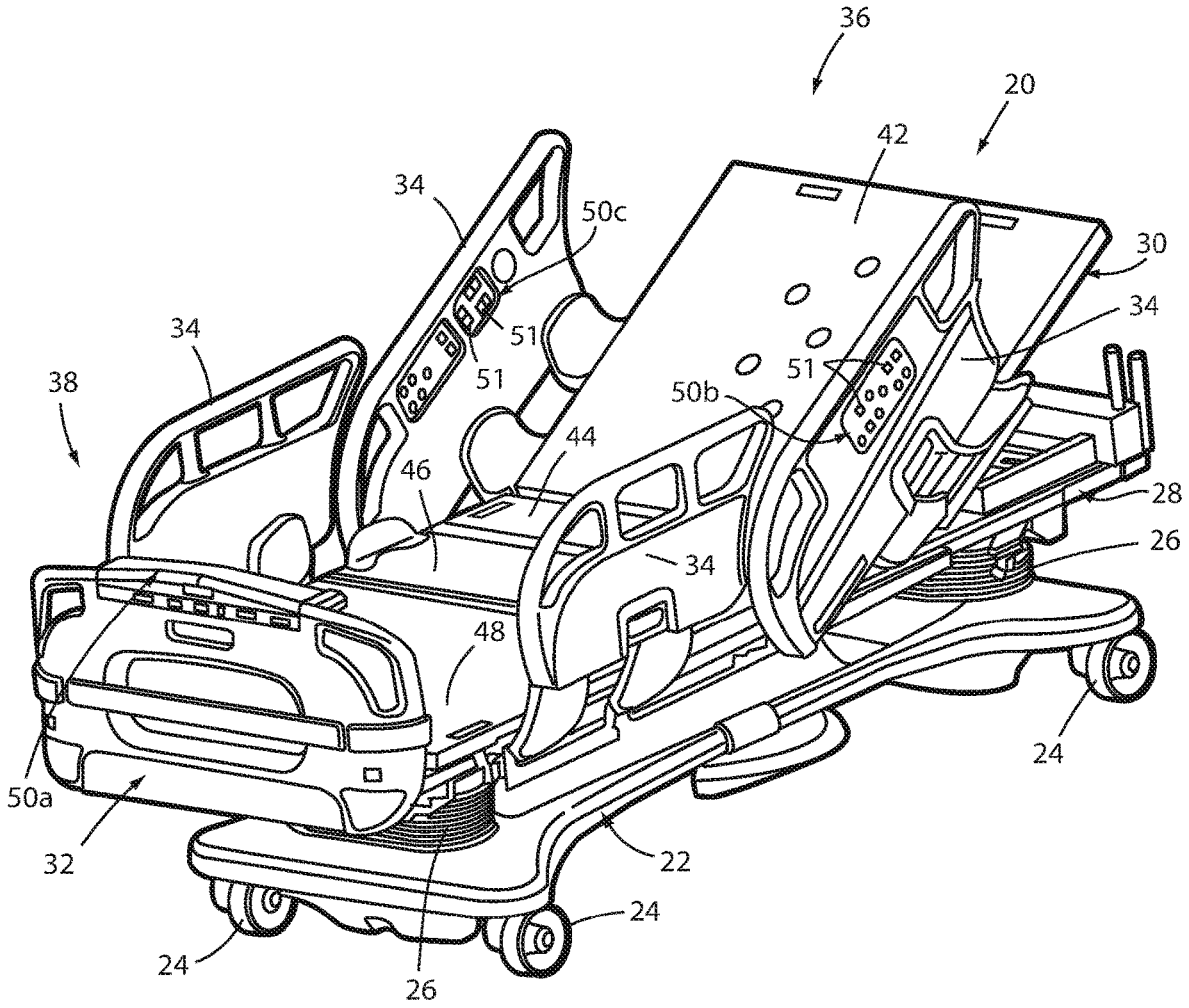
FIG. 1 is a perspective view of a person support apparatus according to a first embodiment of the present disclosure.
Figure 2:
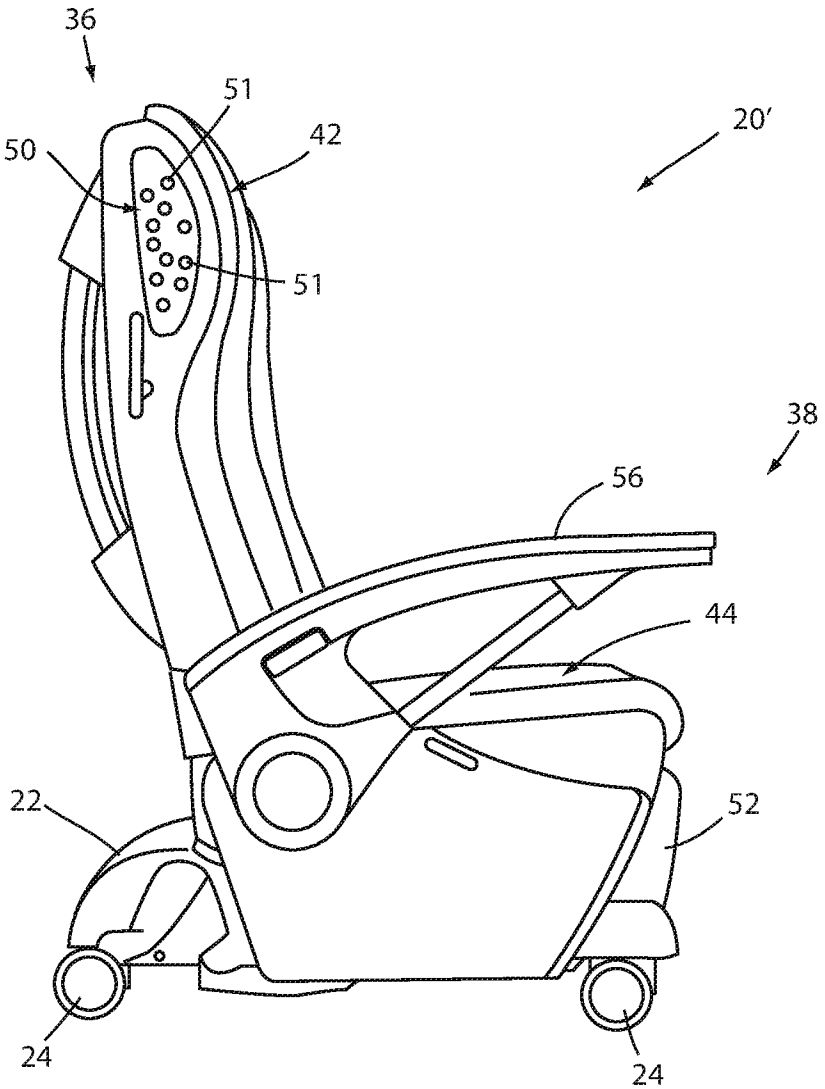
FIG. 2 is a side elevation view of a person support apparatus according to a second embodiment of the present disclosure.
Figure 3:
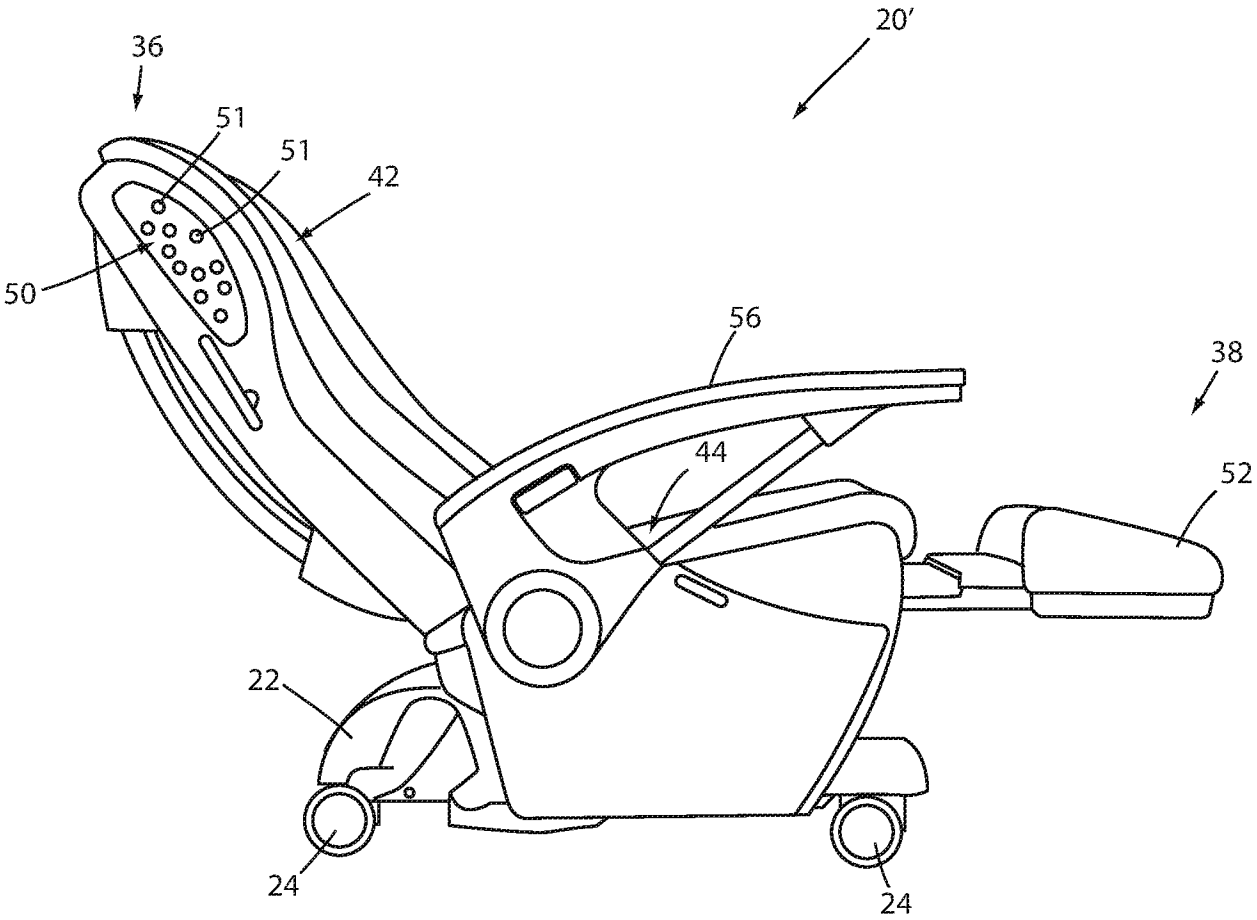
FIG. 3 is a side elevation view of the person support apparatus of FIG. 2 shown with a backrest reclined and a leg rest extended.
Figure 4:
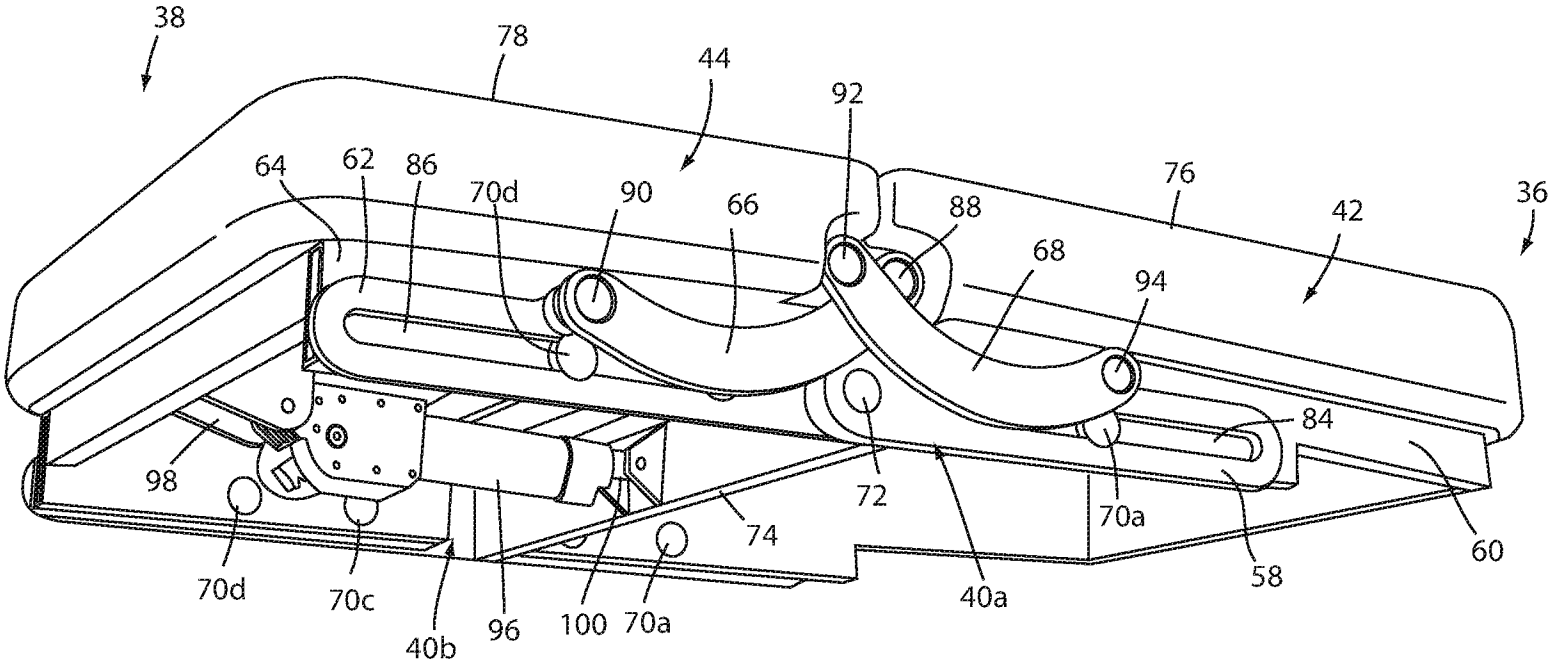
FIG. 4 is a perspective view of a pair of pivot assemblies of the person support apparatuses of FIGS. 1 and 2 showing a seat and backrest in a flat orientation.
Figure 5:
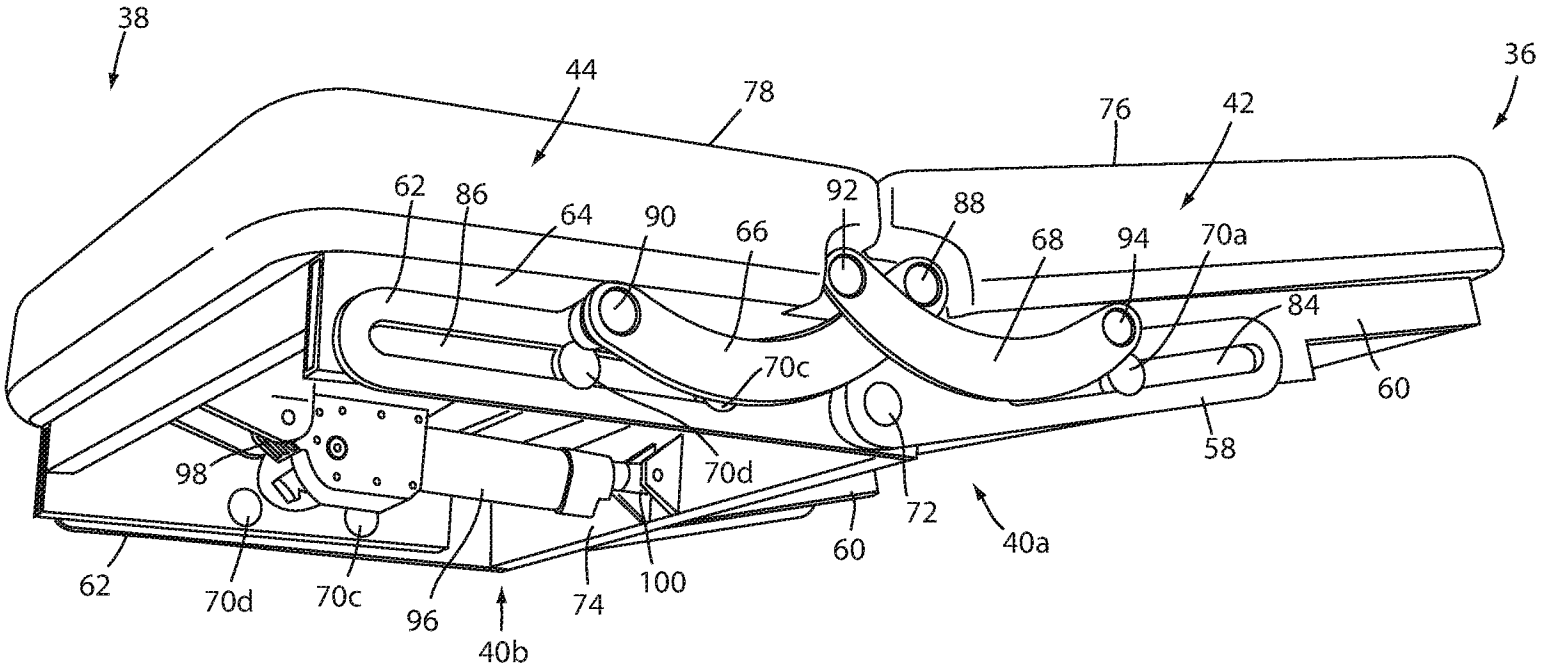
FIG. 5 is a perspective view of the pivot assemblies of FIG. 4 showing the backrest in a first reclined position relative to the seat.
Figure 6:
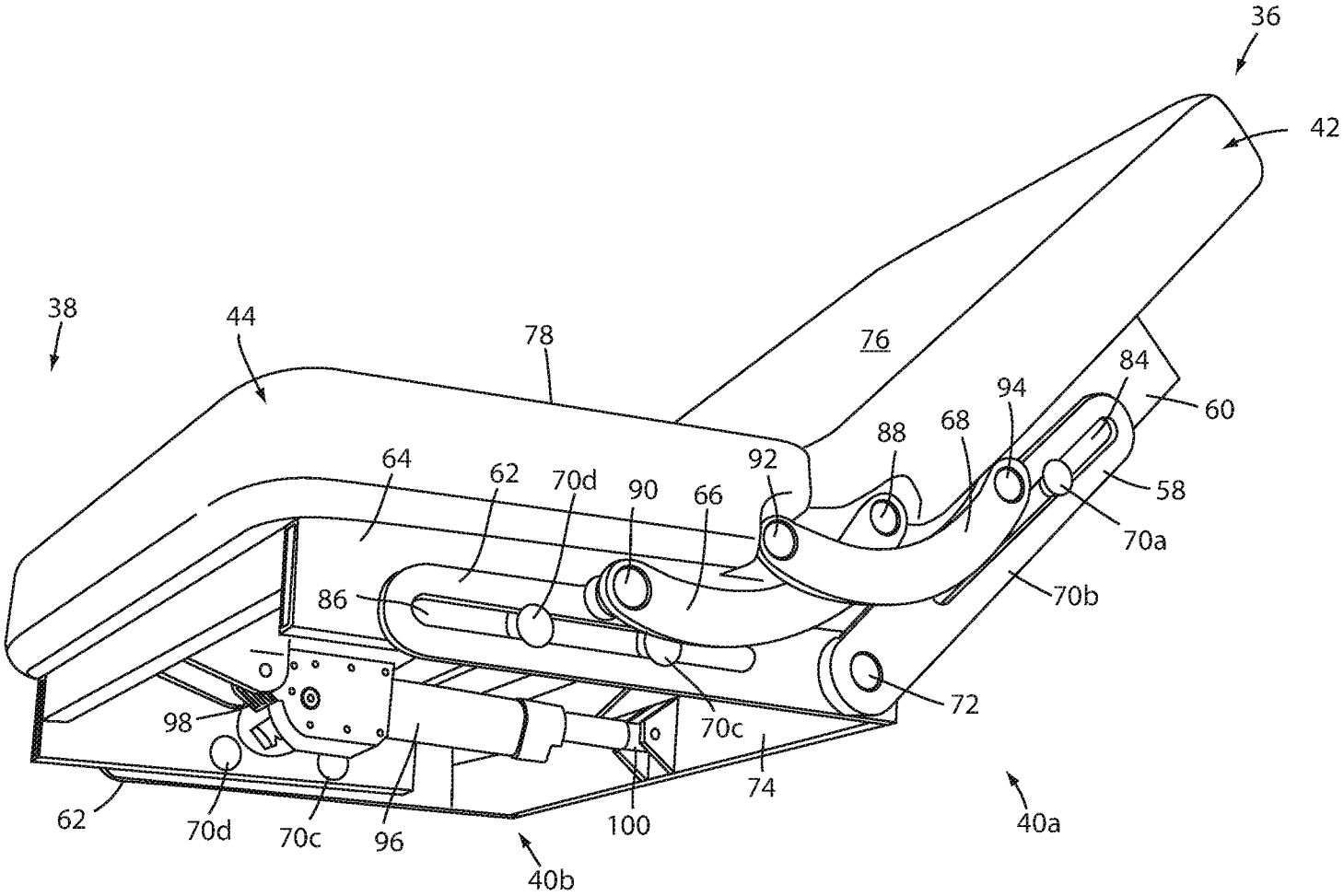
FIG. 6 is a perspective view of the pivot assemblies of FIG. 4 showing the backrest in a second reclined position relative to the seat.

A first illustrative person support apparatus 20 according to a first embodiment of the present disclosure is shown in FIG. 1, and a second illustrative person support apparatus 20' according to a second embodiment of the present disclosure is shown in FIGS. 2-3. Although the particular form of person support apparatuses 20 and 20' are illustrated as a bed in FIG. 1 and as a recliner in FIGS. 2-3, it will be understood that person support apparatuses 20 and 20' could, in different embodiments, be cots, stretchers, wheelchairs, operating tables, dental chairs, or any other structure having a support surface with at least one portion (e.g. a backrest) that is pivotal with respect to another portion of the support surface (e.g. a seat portion).

Person support apparatus 20 of FIG. 1 includes a base 22 having a plurality of wheels 24, a pair of lifts 26 supported on the base 22, a litter frame 28 supported on the lifts 26, and a support deck 30 supported on the litter frame 28. Person support apparatus 20 further includes a footboard 32 (which may be removable) and a plurality of siderails 34. Siderails 34 are all shown in a raised position in FIG. 1 but are each individually movable to a lower position in which ingress into, and egress out of, person support apparatus 20 is not obstructed by the lowered siderails 34.

Lifts 26 are adapted to raise and lower litter frame 28 with respect to base 22. Lifts 26 may be hydraulic actuators, pneumatic actuators, electric actuators, or any other suitable device for raising and lowering litter frame 28 with respect to base 22. In the illustrated embodiment, lifts 26 are operable independently so that the tilting of litter frame 28 with respect to base 22 can also be adjusted. That is, litter frame 28 includes a head end 36 and a foot end 38, each of whose height can be independently adjusted by the nearest lift 26. Person support apparatus 20 is designed so that when a person lies thereon, his or her head will be positioned adjacent head end 36 and his or her feet will be positioned adjacent foot end 38.

Litter frame 28 provides a structure for supporting support deck 30, footboard 32, and siderails 34. Support deck 30 is made of a plurality of sections, some of which are pivotal about generally horizontal pivot axes. In the embodiment shown in FIG. 1, support deck 30 includes a backrest 42, a seat 44, a thigh section 46, and a foot section 48. Backrest 42, which is also sometimes referred to as a Fowler section, is pivotal about a generally horizontal pivot axis between a generally horizontal position (not shown in FIG. 1) and a plurality of raised positions (one of which is shown in FIG. 1). As will be discussed in greater detail below, the pivoting of backrest 42 with respect to seat 44 is accomplished by way of a pair of pivot assemblies 40 (FIGS. 4-7) that cause backrest 42 to pivot in a motion having a moving virtual pivot axis. Thigh section 46 and foot section 48 may also be pivotal about one or more similar pivot assemblies.

Support deck 30 provides a support surface for a mattress (not shown), such as, but not limited to, an air, fluid, or gel mattress. Alternatively, another type of soft cushion may be supported on support deck 30 so that a person may comfortably lie and/or sit thereon. In some embodiments, the mattress or soft cushion is a segmented cushion or mattress that includes individual sections that correspond to the individual sections of support deck 30, such as backrest 42 and seat 44.

Person support apparatus 20 further includes a plurality of user interfaces 50 that enable a user of person support apparatus 20, such as a patient and/or an associated caregiver, to control one or more aspects of person support apparatus 20. In the embodiment shown in FIG. 1, person support apparatus 20 includes a footboard user interface 50*a*, a pair of outer siderail user interfaces 50*b* (only one of which is visible), and a pair of inner siderail user interfaces 50*c* (only one of which is visible). Footboard user interface 50*a* and outer siderail user interfaces 50*b* are intended to be used by caregivers, or other authorized personnel, while inner siderail user interfaces 50*c* are intended to be used by the patient associated with person support apparatus 20. Each of the user interfaces 50 includes a plurality of controls 51, although each user interface 50 does not necessarily include the same controls 51 and/or functionality.

Among other functions, the controls 51 of user interfaces 50 allow a user to control one or more of the following: change a height of support deck 30, pivot backrest 42 between a lowered position and one or more raised positions, activate and deactivate a brake for wheels 24, arm and disarm an exit detection system, and other functions. As will be discussed in greater detail below, when using user interface 50 to control the pivoting of backrest 42 with respect to seat 44, a controller on board person support apparatus 20 activates a powered actuator that drives the backrest upwardly or downwardly, as selected by the user.

Footboard user interface 50*a* is implemented in the embodiment shown in FIG. 1 as a control panel having a lid (flipped down in FIG. 1) underneath which is positioned a plurality of controls. As with all of the controls 51 of the various user interfaces 50, the controls of user interface 50*a* may be implemented as buttons, dials, switches, or other devices. Any of user interfaces 50*a-c* may also include a display for displaying information regarding person support apparatus 20. The display is a touchscreen in some embodiments.

Except for the pair of pivot assemblies 40 between backrest 42 and seat 44 (FIGS. 4-7), person support apparatus 20 may be mechanically constructed in a variety of different way and implement a wide variety of additional functionality beyond that explicitly described herein. Some suitable examples of such mechanical constructions and/or additional functionality are found in the following references, all of which are incorporated herein by reference in their entirety: the Stryker Maintenance Manual for the MedSurg Bed, Model 3002 S3, published in 2010 by Stryker Corporation of Kalamazoo, Mich., U.S. Pat. No. 8,689,376 issued Apr. 8, 2014 by inventors David Becker et al. and entitled PATIENT HANDLING DEVICE INCLUDING LOCAL STATUS INDICATION, ONE-TOUCH FOWLER ANGLE DJUSTMENT, AND POWER-ON ALARM CONFIGURATION; U.S. patent application Ser. No. 13/775,285 filed Feb. 25, 2013 by inventors Guy Lemire et al. and entitled HOSPITAL BED; and U.S. patent application Ser. No. 14/212,009 filed Mar. 14, 2014 by inventors Christopher Hough et al., and entitled MEDICAL SUPPORT APPARATUS. The mechanical construction of those components outside of pivot assemblies 40 of person support apparatus 20 may also take on forms different from what is disclosed in the aforementioned references, and person support apparatus 20 may include still other functionality.

As noted, FIGS. 2-3 show a second embodiment of a person support apparatus 20' implemented as a recliner. Person support apparatus 20' includes a backrest 42, a seat 44, a leg rest 52, a base 22, a pair of armrests 56, a user interface 50, and a plurality of wheels 24 that can be selectively braked and unbraked to allow person support apparatus 20 to be wheeled to different locations. Person support apparatus 20' is constructed such that the height and tilt of seat 44 are adjustable. Further, person support apparatus 20' is constructed such that backrest 42 is pivotal between a generally upright position (which may or may not be completely vertical), such as shown in FIG. 2, and a plurality of rearwardly reclined positions, one of which is shown in FIG. 3 (and which may or may not include a completely horizontal positions).

Leg rest 52 is constructed such that it is able to be moved between a retracted position (FIG. 2) and an extended position (FIG. 3) in which leg rest 52 is oriented generally horizontally to support the person's legs. In one embodiment, leg rest 52 is constructed in any of the manners shown in commonly assigned U.S. patent application Ser. No. 14/212,417 filed Mar. 14, 2014, by inventors Christopher Hough et al. and entitled MEDICAL SUPPORT APPARATUS, the complete disclosure of which is incorporated herein by reference. Other constructions of leg rest 52 are also possible.

Armrests 56 are constructed such that they are pivotable about a substantially horizontal pivot axis between a use position (FIGS. 2 and 3) and a stowed position (not shown). In some embodiments, armrests 56 are constructed in any of the manners disclosed in commonly assigned U.S. patent application Ser. No. 15/267,493 filed Sep. 16, 2016, by inventors Anish Paul et al. and entitled PATIENT SUPPORT APPARATUS, the complete disclosure of which is incorporated herein by reference. Other constructions of armrests 56 are also possible.

In some embodiments, person support apparatus 20' is constructed to be able to move backrest 42 and seat 44 between a seated configuration (FIG. 2) and a standing configuration (not shown). The standing configuration is adapted to more easily allow a patient to either exit from person support apparatus 20' or to enter person support apparatus 20'. One example of such a standing position is shown in FIG. 2 of commonly assigned U.S. patent application Ser. No. 15/602,558 filed May 23, 2017, by inventor Anish Paul and entitled MEDICAL SUPPORT APPARATUS WITH STAND ASSISTANCE, the complete disclosure of which is incorporated herein by reference. Person support apparatus 20' may be configured to move to such a standing configuration, or other types of standing configurations.

Although FIGS. 2 and 3 illustrate person support apparatus 20' having specific orientations for backrest 42, it will be understood that backrest 42 is capable of being moved to a plurality of different orientations beyond what is shown in the accompanying drawings. Such movement occurs, in at least one embodiment, by a user activating a control on user interface 50. In some embodiments, person support apparatus 20' is constructed such that backrest 42, seat 44, and leg rest 52 (in some instances) move together via separate actuators that are coordinated by a controller, such as, but not limited to, a microcontroller. One example of a controller adapted to coordinate motion of backrest 42, seat 44, and leg rest 52 and suitable for inclusion in person support apparatus 20' is disclosed in commonly assigned U.S. patent application Ser. No. 14/801,167 filed Jul. 16, 2015, by inventors Anish Paul et al. and entitled MEDICAL SUPPORT APPARATUS, the complete disclosure of which is incorporated herein by reference.

For both person support apparatuses 20 and 20', backrest 42 is pivotally coupled to seat 44 by way of a pair of pivot assemblies 40*a*, 40*b* (FIGS. 4-7). A first one of the pivot assemblies 40*a* is positioned on a first side of backrest 42 and seat 44 and a second of the pivot assemblies 40*b* is positioned on a second and opposite side of backrest 42 and seat 44. Each pivot assembly 40*a,b* is a mirror image of each other and operates in the same manner. Accordingly, the following description will focus on a single one of the pivot assemblies (referred to herein as "pivot assembly 40") with the understanding that the description applies equally to both pivot assemblies 40*a* and 40*b*.

As can be seen in FIGS. 4-7, pivot assembly 40 includes a backrest slide bar 58 mounted to a backrest body 60, a seat slide bar 62 mounted to a seat body 64, a backrest link 66, a seat link 68, a plurality of supports 70, and a pivot joint 72. Backrest body 60 is a rigid structure that either defines a backrest surface 76, or provides support for an attached backrest surface 76 (FIGS. 4-9). Seat body 64 is a rigid structure that either defines a seat surface 78, or provides support for an attached seat surface 78. Backrest body 60 is shaped to generally define a backrest plane 80, and seat body 64 is shaped to generally define a seat plane 82 (FIGS. 8-9), although it will be understood that neither body necessarily needs to be absolutely planar. It will also be understood, however, that notwithstanding the planes 80 and 82 defined by backrest body 60 and seat body 64, respectively, neither backrest surface 76 nor seat surface 78 need to be planar. Either or both of backrest surface 76 and seat surface 78 may be contoured, defined by molded foam, or otherwise have non-planar aspects to them. Indeed, in some embodiments, a mattress or other cushion is placed on top of backrest 42 and/or seat 44, and the mattress or cushion includes a patient-contacting surface that may be either planar or non-planar.

As backrest 42 pivots with respect to seat 44, backrest slide bar 58 slides along backrest body 60 in a generally linear fashion that is parallel (if not co-planar) to backrest plane 80. This sliding movement can be seen more easily by reviewing the different positions of backrest slide bar 58 in each of FIGS. 4-7 in comparison to backrest body 60. Similarly, as backrest 42 pivots with respect to seat 55, seat slide bar 62 slides along seat body 64 in a generally linear fashion that is parallel (if not co-planar) to seat plane 82. This sliding movement can also be seen more easily by comparing the different positions of seat slide bar 62 in each of FIGS. 4-7 with respect to seat body 64. Pivot joint 72 pivotally couples backrest slide bar 58 to seat slide bar 62.

Backrest slide bar 58 is slidingly supported on backrest body 60 by way of a pair of backrest supports 70*a* and 70*b*. Seat slide bar 62 is slidingly supported on seat body 64 by way of a pair of seat supports 70*c* and 70*d*. Each support 70*a-d* may include a low-friction surface, a roller bearing, or other conventional structure adapted to allow slide bars 58 and 62 to easily slide along bodies 60 and 64, respectively. Each of supports 70*a* and 70*b* are positioned inside of an elongate opening 84 defined in backrest slide bar 58, and each of supports 70*c* and 70*d* are positioned inside of an elongate opening 86 defined in seat slide bar 62. In the illustrated embodiment, elongate openings 84 and 86 are both straight and parallel to their respective backrest and seat planes 80 and 82. Either or both of elongate openings 84 and 86 could be modified to be non-parallel to their respective planes 80 and 82, or to include curvature so as to alter the pivoting motion of backrest 42 with respect to seat 44. The length of elongate openings 84 and 86 may also be shortened or expanded in order to change the range of pivoting of backrest 42 with respect to seat 44.

Backrest link 66 includes a first end 88 pivotally coupled to backrest 42 and a second end 90 pivotally coupled to seat slide bar 62. As seat slide bar 62 slides relative to seat body 64, the coupling of second end 90 to seat slide bar 62 ensures the second end of backrest link 66 slides with seat slide bar 62. Seat link 68 includes a first end 92 pivotally coupled to seat 44 and a second end 94 pivotally coupled to backrest slide bar 58. As backrest slide bar 58 slides relative to backrest body 60, the coupling of second end 94 to backrest slide bar 58 ensures the second end of seat link 68 slides with backrest slide bar 58.

Figure 7:
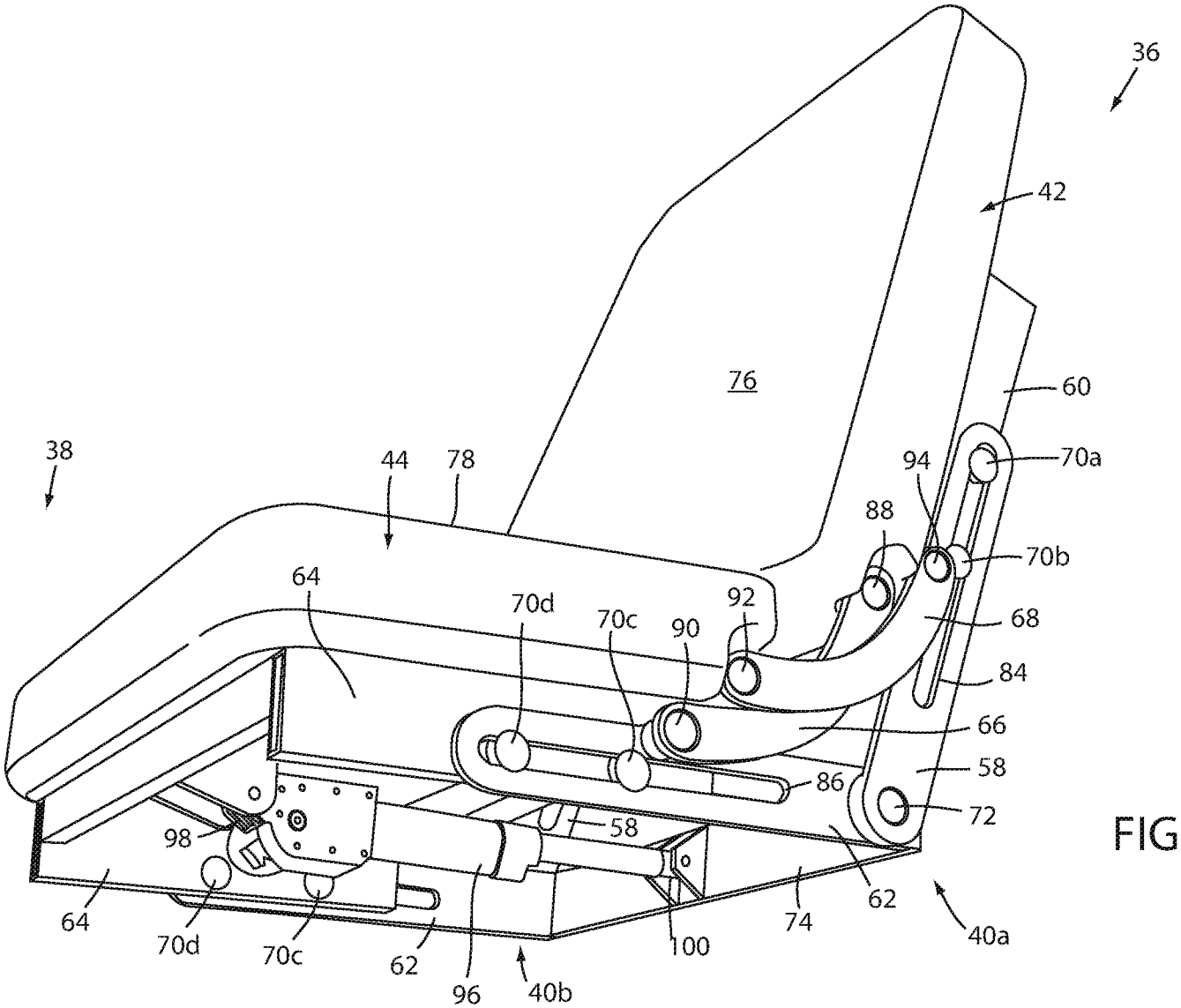
FIG. 7 is a perspective view of the pivot assemblies of FIG. 4 showing the backrest in an upright position relative to the seat.

Seat slide bar 62 of first pivot assembly 40*a* is coupled via a cross-bar 74 to seat slide bar 62 of second pivot assembly 40*b* (FIG. 7). In order to pivot backrest 42 with respect to seat 44, a powered actuator 96 is included within person support apparatuses 20 and 20' that is coupled to cross-bar 74. More particularly, actuator 96 includes a first end 98 pivotally coupled to the underside of seat 44 and a second end 100 pivotally coupled to cross-bar 74. When actuator 96 is activated, it either increases the distance between its first and second ends 98 and 100, or it decreases the distance between its first and second ends 98 and 100, depending upon whether the patient wishes to raise or lower backrest 42. Increasing the distance between ends 98 and 100 raises backrest 42 while decreasing the distance between ends 98 and 100 lowers backrest 42. In the illustrated embodiment, only a single actuator 96 is used to control the motion of backrest 42 relative to seat 44. In other embodiments, however, one or more additional actuators 96 can be used to pivot backrest 42 with respect to seat 44, if desired.

In some embodiments, actuator 96 is an electrical actuator having a motor inside of it, or otherwise driving it. It will be understood, however, that other types of powered actuators may alternatively be used, such as, but not limited to, pneumatic actuators and/or hydraulic actuators. Although not shown in the drawings, actuator 96 is in electrical communication with one or more user interfaces 50 having one or more controls for controlling the movement of actuator 96. In some embodiments, any one or more of the user interfaces 50 may be configured in any of the manners disclosed in commonly assigned U.S. patent application Ser. No. 15/170,979 filed Jun. 2, 2016, by inventors Aaron Douglas et al. and entitled PATIENT SUPPORT APPARATUSES WITH DYNAMIC CONTROL PANELS, the complete disclosure of which is incorporated herein by reference.

In some embodiments, the controller that controls actuator 96 is also configured to control other actuators of person support apparatus 20 and/or 20' (not shown), such as an actuator for controlling lifts 26 of person support apparatus 20, an actuator for controlling leg rest 52 of person support apparatus 20', and/or an actuator for controlling the tilting and/or height of seat 44 of person support apparatus 20'. The control of the motor inside of, or associated with, actuator 96 and/or any of the other actuators (if included) can be carried out in any of the manners disclosed in more detail in commonly assigned U.S. patent application Ser. No. 14/838,693 filed Aug. 28, 2015, by inventors Daniel Brosnan et al. and entitled PATIENT SUPPORT APPARATUS WITH ACTUATOR BRAKE CONTROL, the complete disclosure of which is incorporated herein by reference. Other manners of controlling the motor(s) can also, of course, be used.

Figures 8, 9:
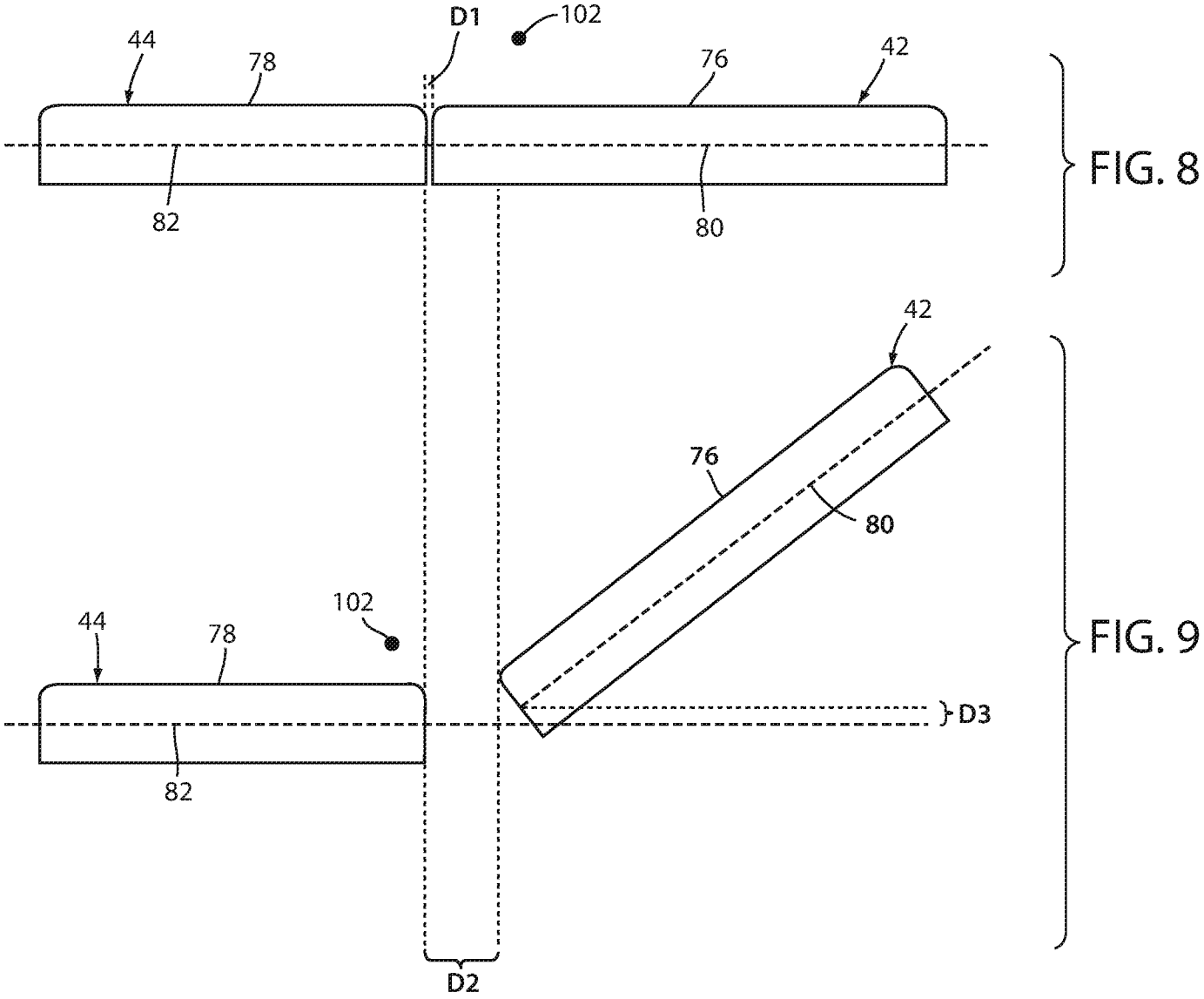
FIG. 8 is a diagram of the seat and backrest showing the backrest and seat in a flat orientation.
FIG. 9 is a diagram showing the backrest in a raised position relative to the seat.

FIGS. 8 and 9 illustrate the manner in which pivot assemblies 40 cause backrest 42 to pivot with respect to seat 44. FIG. 8 shows backrest 42 and seat 44 in a flat orientation while FIG. 9 shows backrest 42 pivoted to a raised orientation relative to seat 44. As can be seen through a comparison of FIG. 8 to FIG. 9, backrest 42 and seat 44 are positioned close together at the same relative height when they are both in the flat orientation (FIG. 8), and backrest 42 shifts rearwardly away and up from seat 44 when it is pivoted upwardly to a raised orientation (FIG. 9). More specifically, when backrest 42 and seat 44 are both flat, backrest 42 is spaced rearwardly from seat 44 by a first distance D1, and both backrest 42 and seat 44 are positioned at substantially the same height (FIG. 8). As backrest 42 pivots upwardly, it moves rearwardly and upwardly such that, when it reaches the orientation illustrated in FIG. 9, backrest 42 is spaced rearwardly from seat 44 a second distance D2 that is greater than D1, and is positioned upwardly from seat 44 a distance D3. Depending upon the particular dimensions of the backrest 42 and seat 44 and the desired feel for a particular person support apparatus, the difference between D2 and D1 may be approximately in the range of one to two inches, while the value of D3 may be approximately in the range of several inches. Other specific values may be used. In the illustrated embodiment, the difference between D2 and D1 is greater than D3. That is, backrest 42 changes its horizontal separation from seat 44 more than it changes its height relative to seat 44 as it pivots.

FIGS. 8 and 9 also illustrate the location of a virtual pivot axis 102 created by the pivoting movement of backrest 42 relative to seat 44. Virtual pivot axis 102 may alternatively be referred to as an instantaneous center of rotation. It is the point that, were it affixed to backrest 42, would experience zero velocity at a particular instant in time as backrest 42 pivots. As can be seen in FIGS. 8 and 9, virtual pivot axis 102 starts at a first location above backrest 42 and rearwardly of seat 44 when both backrest 42 and seat 44 are generally flat. As backrest 42 is pivoted upwardly, virtual pivot axis 102 moves forwardly (toward seat 44) and also lowers its height relative to seat 44. Virtual pivot axis 102 undergoes continuous movement during the pivoting of backrest 42. Such movement follows a curved path between the position of virtual pivot axis 102 shown in FIG. 8 and the position of virtual pivot axis 102 shown in FIG. 9. The precise shape of the curved path can be changed by changing the relative dimensions, positions, and/or angular orientations of the slide bars 58, 62 and links 66, 68 with respect to each other.

Although other pivot constructions may be implemented to provide a continuously moving virtual pivot axis during pivoting of a backrest, pivot assemblies 40 are constructed in a compact manner that reduces the amount of space that might otherwise be necessary to implement the pivoting motion of backrest 42. In the illustrated embodiment, backrest and seat links 66 and 68 do not extend away from backrest surfaces 76 and seat surface 78, respectively, beyond slide bars 58 and 62. Further, by being oriented parallel to planes 80 and 82, slide bars 58 and 62 do not include any protrusions or other structures that extend away from backrest 42 and seat 44, respectively, and whose space-occupying needs would otherwise need to be accommodated in the overall design of person support apparatus 20, 20'.

In the illustrated embodiments, both backrest link 66 and seat link 68 are solid one-piece components made from suitably strong material, such as, but not limited to metal. Similarly, slide bars 58 and 62, and cross-bar 74 are rigid, one-piece components made from suitably strong material, such as, but not limited to, metal. In alternative embodiments, backrest link 66, seat link 68, and slide bars 58 and 62 could be constructed from multiple rigid components or in other manners.

It will be understood that pivot assemblies 40 and person support apparatuses 20 and 20' may be varied from the embodiments shown in the attached drawings and described herein. For example, any of the person support apparatuses 20, 20' may be modified to include only a single pivot assembly 40 (rather than the two shown in FIGS. 4-7) or more than two pivot assemblies 40 for pivoting backrest 42 with respect to seat 44. Pivot assemblies 40 may also be incorporated into other pivoting components of a support surface other than backrest 42, such as, but not limited to, a thigh or leg section of a patient support surface (e.g. thigh section 46 or foot section 48 of support deck 30).

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A person support apparatus comprising:

a frame;

a seat supported on the frame;

a backrest pivotally coupled to the seat such that the backrest is able to pivot with respect to the seat;

a backrest slide bar mounted to the backrest and adapted to slide along the backrest;

a seat slide bar mounted to the seat and adapted to slide along the seat;

a backrest link pivotally coupled to the backrest and the seat slide bar; and a seat link pivotally coupled to the seat and the backrest slide bar.

2. The person support apparatus of claim 1 wherein the backrest defines a backrest plane and the seat defines a seat plane, and wherein the backrest slide bar slides along the backrest parallel to the backrest plane and the seat slide bar slides along the seat parallel to the seat plane.

3. The person support apparatus of claim 2 further comprising:

a first support fixedly coupled to the backrest;

a second support fixedly coupled to the backrest; and a first elongate opening defined in the backrest slide bar, the first and second supports being positioned in the first elongate opening and adapted to support the backrest slide bar as the backrest slide bar slides along the backrest.

4. The person support apparatus of claim 3 further comprising:

a third support fixedly coupled to the seat;

a fourth support fixedly coupled to the seat; and a second elongate opening defined in the seat slide bar, the third and fourth supports being positioned in the second elongate opening of the seat slide bar and adapted to support the seat slide bar as the seat slide bar slides along the seat.

5. The person support apparatus of claim 2 further comprising a pivot joint coupling a first end of the backrest slide bar to a second end of the seat slide bar, the pivot joint enabling the backrest slide bar to pivot with respect to the seat slide bar.

6. The person support apparatus of claim 2 wherein the backrest is adapted to pivot with respect to the seat about a virtual pivot axis that moves as the backrest pivots with respect to the seat, and wherein the virtual pivot axis moves toward a foot end the person support apparatus as the backrest pivots toward an upright position, and the virtual pivot axis moves toward a head end of the person support apparatus as the backrest pivots toward a downward position.

7. The person support apparatus of claim 2 wherein the backrest is adapted to pivot with respect to the seat about a virtual pivot axis that moves as the backrest pivots with respect to the seat and wherein the backrest is adapted to pivot to a flat position in which the backrest plane is substantially parallel to the seat plane.

8. The person support apparatus of claim 2 further comprising:

a second backrest slide bar mounted to the backrest and adapted to slide along the backrest parallel to the backrest plane;

a second seat slide bar mounted to the seat and adapted to slide along the seat parallel to the seat plane;

a second backrest link pivotally coupled to the backrest and the second seat slide bar;

a second seat link pivotally coupled to the seat and the second backrest slide bar;

a cross-bar coupled between at least one of the following: (1) the first and second backrest slide bars, and (2) the first and second seat slide bars; and an electric actuator having a first end coupled to the cross-bar and a second end coupled to at least one of the seat and the backrest.

9. The person support apparatus of claim 3 wherein the first elongate opening is a straight opening.

10. A person support apparatus comprising:

a frame;

a seat supported on the frame;

a backrest pivotally coupled to the seat such that the backrest is able to pivot with respect to the seat;

a first backrest slide bar mounted to a first side of the backrest and adapted to slide along the backrest;

a second backrest slide bar mounted to a second side of the backrest and adapted to slide along the backrest;

a first seat slide bar mounted to a first side of the seat and adapted to slide along the seat;

a second seat slide bar mounted to a second side of the seat and adapted to slide along the seat;

a first pivot joint coupling the first backrest slide bar to the first seat slide bar;

a second pivot joint coupling the second backrest slide bar to the second seat slide bar; and an actuator adapted to exert a force against the first and second pivot joints such that the backrest pivots with respect to the seat.

11. The person support apparatus of claim 10 further comprising:

a first backrest link pivotally coupled to the backrest and the first seat slide bar;

a second backrest link pivotally coupled to the backrest and the second seat slide bar;

a first seat link pivotally coupled to the seat and the first backrest slide bar; and a second seat link pivotally coupled to the seat and the second backrest slide bar.

12. The person support apparatus of claim 11 further comprising:

a first support fixedly coupled to the first side of the backrest;

a second support fixedly coupled to the first side of the backrest;

a third support fixedly coupled to the second side of the backrest;

a fourth support fixedly coupled to the second side of the backrest;

a first elongate opening defined in the first backrest slide bar, the first and second supports being positioned in the first elongate opening and adapted to support the first backrest slide bar as the first backrest slide bar slides along the backrest; and a second elongate opening defined in the second backrest slide bar, the third and fourth supports being positioned in the second elongate opening and adapted to support the second backrest slide bar as the second backrest slide bar slides along the backrest.

13. The person support apparatus of claim 12 further comprising:

a fifth support fixedly coupled to the first side of the seat;

a sixth support fixedly coupled to the first side of the seat;

a seventh support fixedly coupled to the second side of the seat;

an eighth support fixedly coupled to the second side of the seat;

a third elongate opening defined in the first seat slide bar, the fifth and sixth supports being positioned in the third elongate opening of the first seat slide bar and adapted to support the first seat slide bar as the first seat slide bar slides along the seat; and a fourth elongate opening defined in the second seat slide bar, the seventh and eighth supports being positioned in the fourth elongate opening of the second seat slide bar and adapted to support the second seat slide bar as the second seat slide bar slides along the seat.

14. The person support apparatus of claim 10 wherein the backrest is adapted to pivot with respect to the seat about a virtual pivot axis that moves as the backrest pivots with respect to the seat, and wherein the virtual pivot axis moves toward a foot end of the person support apparatus as the backrest pivots toward an upright position, and the virtual pivot axis moves toward a head end of the person support apparatus as the backrest pivots toward a downward position.

15. The person support apparatus of claim 11 further comprising a cross-bar extending between the first and second pivot joints, the actuator including a first end coupled to the cross-bar and a second end coupled to one of the seat and backrest.

16. The person support apparatus of claim 11 wherein the seat defines a seat plane, the backrest defines a backrest plane, the first and second seat slide bars move parallel to the seat plane when the backrest pivots with respect to the seat, and the first and second backrest slide bars move parallel to the backrest plane when the backrest pivots.

17. A person support apparatus comprising:

a frame;

a seat supported on the frame;

a backrest pivotally coupled to the seat;

a backrest slide bar slidingly mounted to the backrest and including a first straight opening defined therein;

a seat slide bar slidingly mounted to the seat and including a second straight opening defined therein; and wherein the backrest slide bar and seat slide bar are adapted to cause the backrest to pivot with respect to the seat about a virtual pivot axis that moves along a curved path as the backrest pivots.

18. The person support apparatus of claim 17 further comprising:

a pivot joint coupling a first end of the backrest slide bar to a second end of the seat slide bar, the pivot joint enabling the backrest slide bar to pivot with respect to the seat slide bar;

wherein the backrest defines a backrest plane and the seat defines a seat plane; and wherein the backrest slide bar slides along the backrest parallel to the backrest plane and the seat slide bar slides along the seat parallel to the seat plane.

19. The person support apparatus of claim 18 further comprising:

a first support fixedly coupled to the backrest and positioned in the first straight opening;

a second support fixedly coupled to the backrest and positioned in the first straight opening, wherein the first and second supports are adapted to support the backrest slide bar as the backrest slide bar slides along the backrest;

a third support fixedly coupled to the seat and positioned in the second straight opening; and a fourth support fixedly coupled to the seat and positioned in the second straight opening, wherein the third and fourth supports are adapted to support the seat slide bar as the seat slide bar slides along the seat.

20. The person support apparatus of claim 17 wherein the virtual pivot axis moves along the curved path toward a foot end the person support apparatus as the backrest pivots toward an upright position, and the virtual pivot axis moves along the curved path toward a head end of the person support apparatus as the backrest pivots toward a downward position; and wherein the backrest is adapted to pivot to a flat position in which the backrest plane is substantially parallel to the seat plane.

* * * * *